United States Patent [19]

Reed et al.

[11] 4,383,649

[45] May 17, 1983

[54] FUEL OIL ATOMIZER

[75] Inventors: Robert D. Reed; Richard R. Martin; Hershel E. Goodnight, all of Tulsa, Okla.

[73] Assignee: John Zink Company, Tulsa, Okla.

[21] Appl. No.: 169,993

[22] Filed: Jul. 18, 1980

[51] Int. Cl.[3] ..... B05B 7/04

[52] U.S. Cl. ..... 239/429; 239/433; 239/567

[58] Field of Search ..... 239/405, 416.5, 429, 239/430, 432, 433, 567, 137, 139, 8

[56] References Cited

U.S. PATENT DOCUMENTS

| | | | |
|---|---|---|---|
| 1,522,951 | 1/1925 | Gilmore | 239/430 |
| 1,999,121 | 4/1935 | Wilson | 239/432 |
| 2,613,737 | 10/1952 | Schwietert | 239/567 |
| 2,933,259 | 4/1960 | Raskin | 239/567 |
| 3,493,181 | 2/1970 | Goodnight et al. | 239/434.5 |

*Primary Examiner*—Bruce H. Stoner, Jr.
*Assistant Examiner*—Michael J. Forman
*Attorney, Agent, or Firm*—Head, Johnson & Stevenson

[57] ABSTRACT

An improved fuel oil atomizer which comprises a burner tube through which fuel oil is supplied under selected pressure, and a coaxial surrounding steam tube providing an annular space therebetween, the flow of steam being under greater pressure than the oil pressure. A burner head is joined to the burner oil tube through an orifice of selected diameter. The burner head has a long axial bore of constant selected diameter, which leads to the burner tip, which has a plurality of tip ports. There are a number of transverse ports between the annular steam path and the central bore, so that the steam can flow under pressure into the central bore of the burner head to mix thoroughly with the pressurized oil flowing from the orifice. Two factors are important in the construction of the burner head, namely that the central bore must be of constant diameter from the point where the steam and oil mix, outwardly toward the burner tip ports. Secondly, the total cross-sectional area of the tip ports must be less than the cross-sectional area of the central bore.

3 Claims, 3 Drawing Figures

FUEL OIL ATOMIZER

BACKGROUND OF THE INVENTION

This invention lies in the field of systems for burning fuel oil. More particularly, it concerns apparatus for atomizing the fuel oil in preparation for discharge into the flame zone in the combustion chamber. Still more particularly, it concerns the design of a liquid fuel atomizer which will provide particles of liquid fuel of the least possible size for rapid evaporation and combustion, with good flame characteristics.

Systems long have been known for atomization of oil in immediate preparation for its burning as fuel. However, the term "atomization" is a gross misnomer since the liquid oil is not, literally, broken-up into its component atoms, but is caused to be broken up into micron-size particles which are small enough for instant vaporization or conversion from liquid to the gaseous state in the flame. Oil, to burn, must be in the gaseous state in order to mix with air for burning, in a series of heat-productive oxidation chemical reactions. The oil, a hydrocarbon, is through oxidation converted to carbon dioxide and water vapor, at a very high temperature in the flame.

There are two generic systems for atomization of oil, on which there are myriad variations which are well-known to those versed in the art. One system known as the "outside-mix" was initially used at the expense of great steam consumption for atomization. A second system quickly came into being for steam conservation. It is called the "inside-mix". Nomenclature denotes the point at which oil and steam are mixed in preparation for atomization. There is little cause for speculation as to how the typical "outside-mix" atomizer functions, and atomization is attributed to the 'shearing' action of steam on oil. Over the years, there has been considerable academic discussion as to why the 'inside-mix' atomizer reduces steam demand; also as to how it functions. One school holds that the pressurized steam-oil mixture greatly enchances high-energy steam-oil contact for better 'shearing' action. Another school holds that the pressurized steam-oil contact creates a high-pressure steam and oil bubbly emulsion which, upon reaching atmospheric pressure, explodes to form the required micron-size droplets.

The "how-and-why" discussion is academic because the inside-mix burners require only a small fraction of the atomizing steam for a specific heat release, that would be required for outside-mix operation. But there is significant variation in steam demand for atomization as between different inside-mix oil atomizers. Desperately needed steam conservation measures prompt research toward minimization of steam for atomization, in view of the current energy situation.

The excellence of any atomizer, at any steam consumption rate, is based on the quality of oil flame it produces. That is, if reduction in steam quantity results in an intolerable flame condition, there is no solution toward steam demand reduction, and all atomizers must be judged as at a minimal steam consumption basis for comparison. Steam consumption measurement is taken as "pounds of steam per pound of oil". Each pound of #6 (bunker C) oil when completely burned produces a heat release (lower heating value) of very close to 17,500 btu. Lowest practical heat release per atomizer is 2,000,000 btu/hr and the maximum may be as great as 200,000,000 or even more. Demand for atomizing steam on a pound-per-pound basis increases as heat release per atomizer decreases and the steam requirement decreases as the heat release per atomizer increases. Thus, it is common to use 8,000,000 btu/hr heat release for checking atomizer steam demand. On this basis, the atomizer design of this invention requires less steam than any other design for production of a satisfactory flame.

SUMMARY OF THE INVENTION

It is a primary object of this invention to provide an oil fuel atomizer, which, on a pound-for-pound ratio of steam to oil, will provide a satisfactory flame, with the minimum ratio of steam to oil.

These and other objects are realized, and the limitations of the prior art are overcome in this invention, by providing an improved fuel oil atomizer, which comprises a burner tube through which fuel oil is supplied under selected pressure, and a coaxial surrounding steam tube providing an annular space therebetween. The flow of steam is under selected pressure greater than the oil pressure. A burner head is joined to the oil burner tube through an orifice of selected diameter. The burner head has a long axial or central bore of constant selected diameter, which leads to the burner tip, which has a plurality of tip ports. There are a number of transverse ports between the annular steam path and the central bore, so that steam can flow under pressure into the central bore of the burner head to mix thoroughly with the pressurized oil flowing from the orifice. Two factors are very important in the construction of the burner head, namely that the central bore must be of constant diameter from the point where the steam and oil mix, outwardly toward the burner tip ports. Secondly, the total cross-sectional area of the tip ports must be less than the cross-sectional area of the central bore.

It is to be understood that, in the art of 'inside-mix' atomizers, the steam and oil are brought together under pressure inside the atomizer and then conducted, in varying manners, to the tip discharge ports, for flow to an atomospheric pressure condition in the burning zone, where the oil burns after discharge as micron-size and larger droplets. Excellence of flame production favors extremely tiny droplets. As oil droplets become overly large, the appearance of the flame deteriorates; the flame becomes smoky and burning globules of oil emerge from it. As performance further deteriorates, the burner (atomizer) may lose ignition, which is very dangerous. There are countless oil atomizer designs based on the 'inside-mix' principle but, to the best of applicants' knowledge, none of them incorporates an 'after-mixture' flow area to the tip ports which is uninterrupted all the way to tip ports, from the point of mixture, and where the area of the flow-path to the tip ports is slightly greater than the total cross-sectional area of tip ports.

This relationship of after-mixture constant diameter for the flow path to the tip ports, plus a slightly less total tip area than the flow path area, has been unobvious previously; is new and unique to the best of applicants' knowledge and it accounts for reduction in pounds of steam per pound of oil burned, which is a new and previously unobvious (as well as useful) end result.

Since the flow path area from the point at which steam and oil come together, all the way to tip ports entry, is of identical diameter and cross-sectional area, there is no pressure drop between mixture and port entry, and pressure-drop effect on the mixture does not exist for any harmful effect on ultimate atomization beyond the tip ports; also that the total port area is slightly less than the flow-path area for mixture pressure maintenance to immediately prior to discharge to atmospheric pressure from mixture pressure, which is significantly greater than atmospheric pressure.

If there is any increase in flow-path area between the point where the steam and oil are combined and the tip port area, repeated research confirms sharp decrease in atomization quality; impairment in flame appearance; tendency for emergence of burning oil droplets from the body of the flame and a marked tendency to smoky flame production. These conditions are intolerable in use of oil as fuel for any service. The flow-path enlargement between mixture and tip ports need be only very small to cause deterioration in atomization quality such as is described.

Atomization of oil occurs immediately as the steam-oil emerges from the plural tip ports. The purpose of the plural tip ports is to shape the flame produced as the atomized oil burns immediately downstream of the atomizer tip. The flame is shaped according to the requirements of the fuel-burning service by selection of tip-port number; divergence of tip port axes from the atomizer centerline, and whether the divergence is, or is not uniform as the tip port pattern is established. Tip-port patterns are generally circular, but at times they can be 'straight-line'.

There has been reference to fineness of particle size, and fineness has been qualified as 'micron-size'. A micron is defined as 0.000039". Particles must be considered as spherical. Heat is absorbed for vaporization of the particle by its surface. If the diameter of a droplet is doubled, its surface area is increased by a factor of 4, but its mass is increased by a factor of 8. Thus, there is twice the mass per unit area and the droplet evaporation time is doubled. Evaporation time increase for oil droplets results in flame deterioration, and the degree of flame deterioration determines atomization quality in any condition of steam consumption. It is not intended to create the impression that 1 micron diameter droplets are characteristic of the atomizer of this invention or of any atomizer. It is intended to say that the droplets from this atomizer have diameters which are measured, best, in microns. However, and to the best of knowledge, there is no procedure for accurately measuring specific diameters. It is known through long practice that extremely small oil particles are much preferred for satisfactory oil burner operation.

BRIEF DESCRIPTION OF THE DRAWINGS

These and other objects and advantages of this invention and a better understanding of the principles and details of the invention will be evident from the following description taken in conjunction with the appended drawings, in which.

DETAILED DESCRIPTION OF THE PREFERRED EMBODIMENTS

Figure 1:
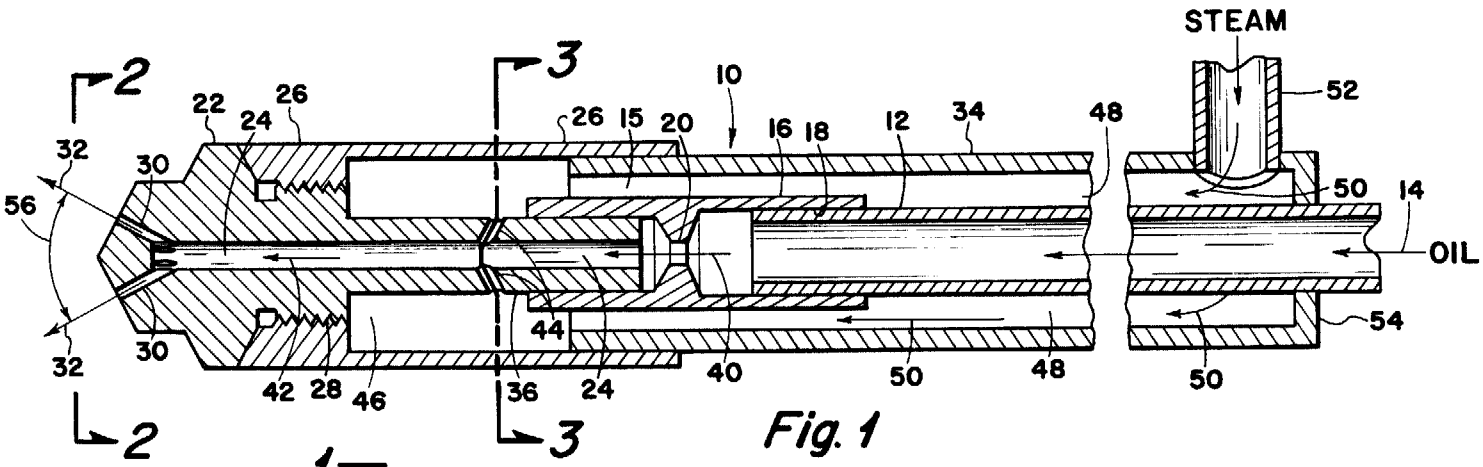
FIG. 1 represents in cross-section one embodiment of the atomizer of this invention.

Referring now to the drawings, there is shown and indicated generally by the numeral 10 one embodiment of this invention. There is a burner tube 12 through which fuel oil flows in accordance with arrow 14 under suitable selected pressure. An orifice 20 follows the oil burner tube, the orifice being of selected size so as to meter the quantity of oil flowing. A junction fixture 16 is adapted to couple the oil burner tube 12 with a tubular portion of the burner head 22.

The tubular portion 36 has a central bore 24 of selected constant diameter. The outlet of the orifice 20 leads into the central or axial bore 24, which extends forwardly into the burner tip, and to a plurality of burner tip ports 30. The number of ports and their angular direction 56 is a matter of choice. However, it is very important that the total cross-sectional area of the plurality of ports 30 must, in total, be less than the cross-sectional area of the central bore 24.

A larger steam burner tube 34 surrounds, coaxially, the oil burner tube, and is closed at its leading edge against the outer surface of the oil burner tube. Steam can be introduced through a side tube 52 under pressure, into the annular space 48 between the oil burner tube 12 and the steam burner tube 34. At the termination of the fixture 16 which supports the tubular portion of the burner head, there are a plurality of circumferentially-spaced transverse ports or orifices 44 which connect the annular steam space 15 to the inner bore of the burner head. Thus, steam flows through the annular space down through the transverse ports 44 to mix with the pressurized oil flowing out of the orifice 20 and into the central bore 24.

From the plane 3—3 positioned transverse to the axis of the atomizer at the point where the steam flows from the annular space into the central bore, forwardly through the central bore to the burner head tip, the diameter and cross-section of the bore must remain constant. And, as previously mentioned, the total cross-sectional area of all of the burner tip ports 30 must be less than the cross-sectional diameter of the central bore 24.

The burner head tip carries a threaded 28 skirt 26 which extends backwards from the tip a sufficient distance to be joined to the steam burner tube 34 in any desired manner. This skirt forms an annular steam plenum 46. Similarly, the junction between the oil burner tube 12 and the fixture 16 and the elongated portion 36 of the burner tip can be joined in any desired manner, so as to facilitate assembly and disassembly of the head for cleaning and other purposes. Some of these joints can be threaded. Others can be brazed and still others can be a slip fit in order to provide some means for relative elongation of one part or the other of the long burner system, because of thermal expansion.

Figure 2:
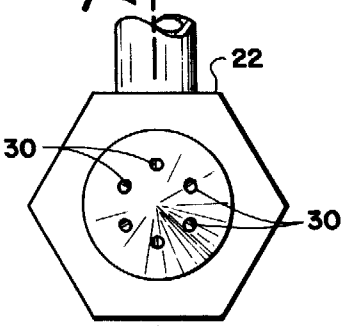
FIG. 2 illustrates a view of the apparatus of FIG. 1 taken across the plane 2—2.

In the drawings there are six burner tip ports 30 shown in FIGS. 1 and 2. These are directed outwardly at a selected angle 56 so as to spray a conical sheet of atomized particles from the burner tip. In other instances, the ports can be arranged in a plane with different angles of direction, or in any other combination of angles that might be desired. Whatever the direction and number of the ports, their total cross-sectional area, of course, must be less than the area of the central bore, and the central bore should be constant in diameter from the point wherein steam is injected into the oil, to the entry into the tip ports. These requirements are important, because it is important not to have any expansion of cross-section where there would be a drop of pressure within the flowing mixture of steam and oil until the point is reached at the outer end of the tip ports, where a high-pressure mixture of steam and oil suddenly goes into the atmosphere and the steam and oil mixture explodes into a large number of the micron-sized particles.

Figure 3:
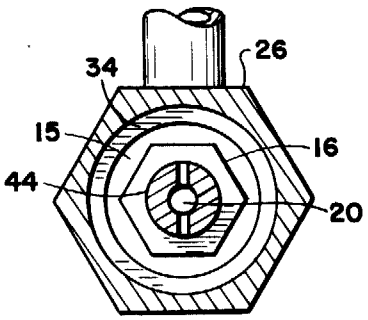
FIG. 3 illustrates a cross-section of the apparatus of FIG. 1 taken across the plane 3—3.

FIG. 3 illustrates a cross-section of the burner system taken at the plane 3—3 of FIG. 1. The plane is curved in order to fit the slope of the transverse orifices 44 and the cross-section of FIG. 3 shows that there are two such orifices and that they are tilted at an angle of less than 90° to the axis of the central bore. The number of orifices 44 is a matter of choice. Whatever the number, they should be equally spaced circumferentially.

Extensive research and testing of the prior art atomizers and of various research models of the atomizer of this invention, has proved that, with the two-dimensional requirements previously stated, the design of the embodiment described in the drawings provides for a finer flow of micron-sized particles than did any of the others that were tested.

While the invention has been described with a certain degree of particularity, it is manifest that many changes may be made in the details of construction and in the arrangement of components. It is understood that the invention is not to be limited to the specific embodiments set forth herein by way of exemplifying the invention, but the invention is to be limited only by the scope of the attached claims, including the full range of equivalency to which each element or step thereof is entitled.

What is claimed is:

1. An improved oil fuel atomizer, to provide a stream of atomized oil particles to be evaporated in the flame of a combustion zone, comprising:

(a) a burner tube, through which fuel oil is supplied under pressure;

(b) a burner head joined coaxially to the distal end of said burner tube; said burner head having a long axial bore of constant selected diameter, leading to a tip having a plurality of tip ports an orifice of smaller diameter than said burner tube and said long axial bore positioned between said burner tube and said burner head, said long axial bore being of smaller internal diameter than said burner tube; the total cross-sectional area of said tip ports being less than the cross-sectional area of said axial bore;

(c) a steam tube coaxially surrounding said burner tube, forming an annular space therebetween, and means to direct pressurized steam through said annular space;

(d) a plurality of transverse ports drilled between said annular space and said axial bore said transverse ports being in spaced radial planes, and directed inwardly and forwardly;

whereby pressurized steam will flow from said annular space through said transverse ports to mix with said pressurized oil, and said pressurized mixture of steam and oil will flow along said axial bore and through said tip ports to the atmosphere;

whereby said oil will be atomized and evaporated as it flows to atmospheric pressure out of said tip ports into the flame.

2. The oil fuel atomizer as in claim 1 in which said tip ports are arranged in equally-spaced radial planes at selected angles outwardly from the axis of said central bore.

3. The oil fuel atomizer as in claim 1 in which the pressure of said steam is greater than the pressure of said fuel oil.

* * * * *